US005868099A

United States Patent [19]

Begin

[11] Patent Number: 5,868,099

[45] Date of Patent: Feb. 9, 1999

[54] PAGE CLAMPING DEVICE

[75] Inventor: Robert George Begin, P.O. Box 2297, Santa Barbara, Calif. 93120-2297

[73] Assignee: Robert George Begin, Santa Barbara, Calif.

[21] Appl. No.: 918,239

[22] Filed: Aug. 25, 1997

[51] Int. Cl.[6] ..... B42D 9/00

[52] U.S. Cl. ..... 116/234; 116/237; 281/42; 24/332; 24/338; 24/495; 24/509; 269/152; 269/238; 269/254 CS

[58] Field of Search ..... 116/234, 235, 116/236, 237, 238, 239; 40/352, 357; 281/42, 45; 254/495, 509, 332, 338; 269/152, 238, 254 CS

[56] References Cited

U.S. PATENT DOCUMENTS

| | | | |
|---|---|---|---|
| 369,217 | 8/1887 | Thompson | 281/42 |
| 527,524 | 10/1894 | Elderkin | 281/42 |
| 606,924 | 7/1898 | Hale | 281/42 |
| 1,700,846 | 2/1929 | Klein | 116/237 |
| 3,737,178 | 6/1973 | Tjernlund et al. | 281/42 |
| 5,382,055 | 1/1995 | Bettiol | 281/42 |
| 5,433,415 | 7/1995 | Samson et al. | 248/448 |
| 5,722,691 | 3/1998 | Patel | 281/42 |

*Primary Examiner*—Richard Chilcot
*Assistant Examiner*—Willie Morris Worth
*Attorney, Agent, or Firm*—Ellsworth R. Roston; Fulwider Patton Lee & Utecht, LLP

[57] ABSTRACT

First and second pairs of arms are respectively disposed at opposite ends of a support structure. A constrainable member (e.g., a spring) is supported at its opposite ends by corresponding ones of the arms in the pairs. This is the only constrainable member in the page clamping device. When the spring is unconstrained, the arms in each pair are normally closed. The arms in each pair are pivotable independently of the arms in the other pair. The arms in each pair have at first positions camming peripheries which cause one of such arms to pivot when the other of such arms is pivoted. The arms in each pair have at second positions camming peripheries which provide a stable relationship between the arms when the arms are in an open position. The arms in each pair are disposed on the opposite sides of a book from the arms in the other pair. With the arms in the open relationship, the pages can be easily turned. When the arms in each pair are pivoted from the open relationship, the arms in such pair become pivoted toward the closed relationship as a result of the constraint on the spring. This causes the arms to clamp the pages on the same side of the book as such arms. Fingers made from a soft non-skid material (e.g., vinyl) may extend from the arms in a transverse direction for disposition on the pages to prevent damage to the pages when the pages are clamped.

20 Claims, 4 Drawing Sheets

FIG. 3
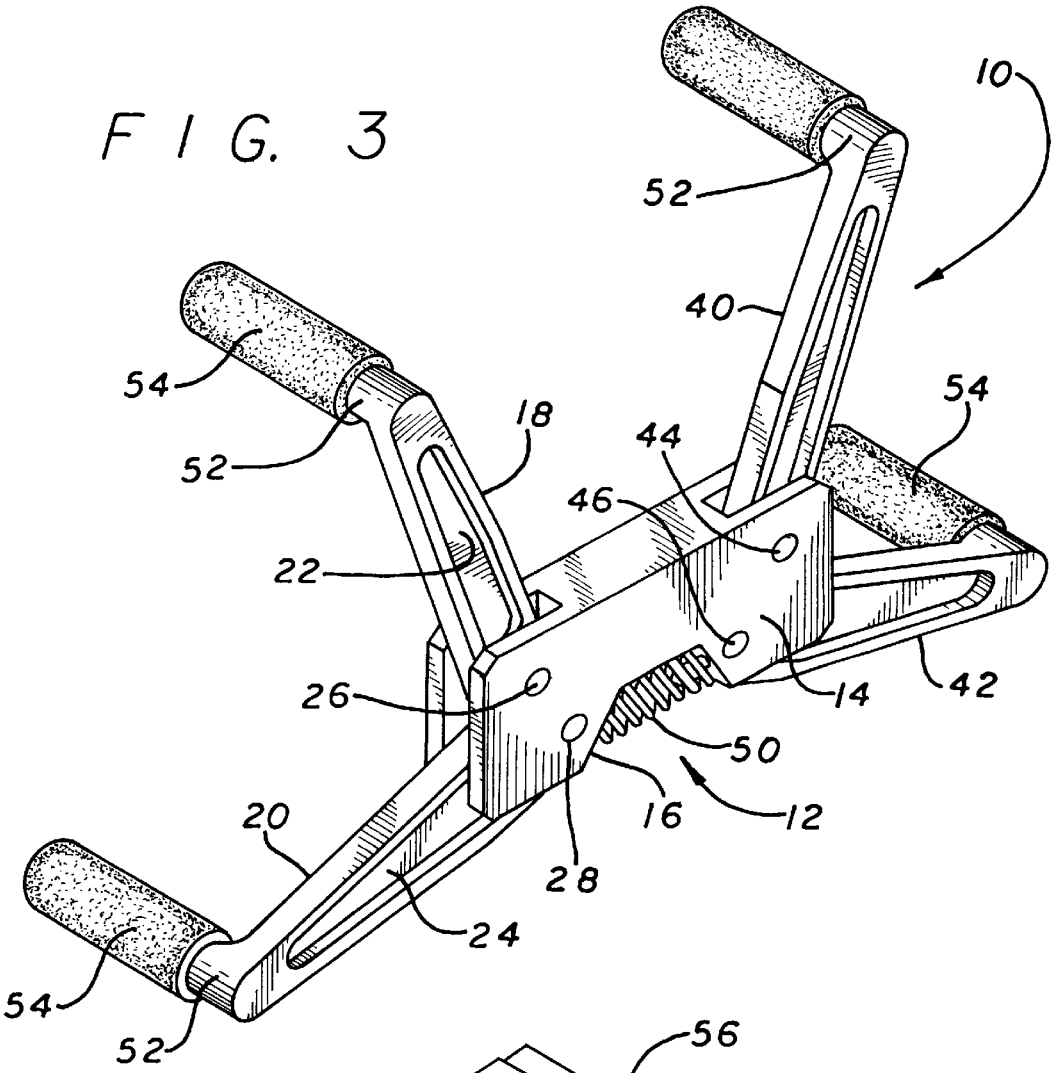
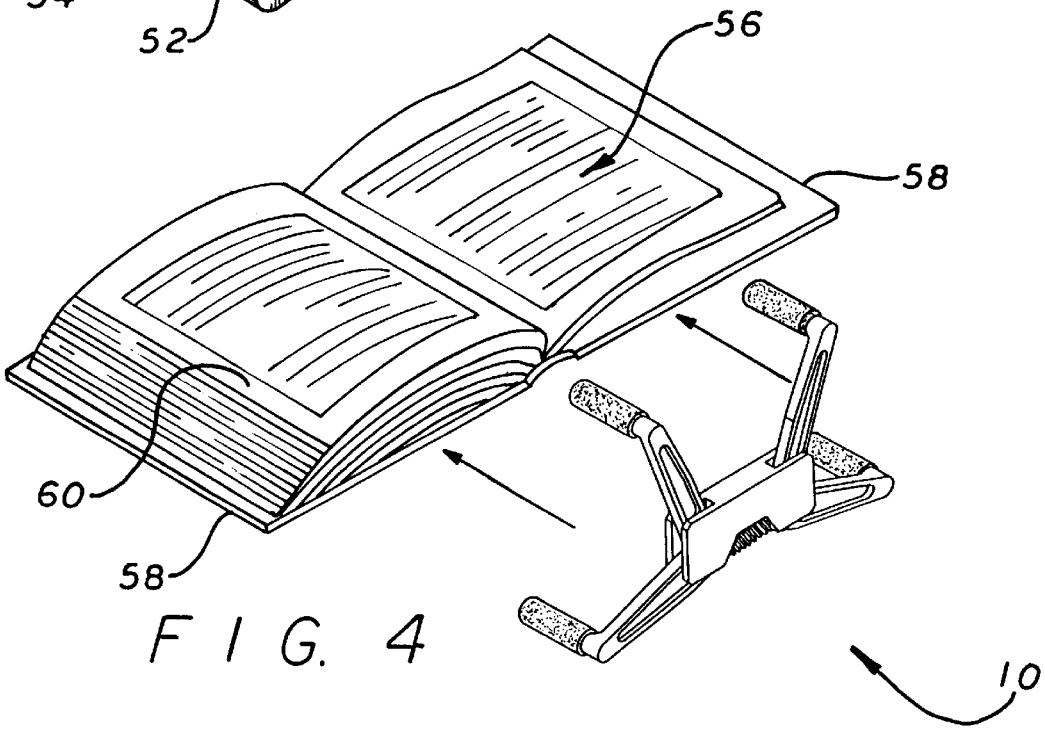
FIG. 4

PAGE CLAMPING DEVICE

This invention relates to apparatus for clamping the pages of a book to maintain the book open to the page at which an individual is reading.

BACKGROUND OF THE INVENTION

A person reading a book often becomes interrupted, sometimes every few pages, before that person has finished reading the book. When the reader becomes interrupted, the reader sometimes provides a marker at each page and then closes the book with the marker protruding from the book at such page. However, the reader generally prefers to maintain the book open at such page with the assurance that the book will remain open at such page. This is particularly true since page markers often become misplaced.

Many different types of apparatus have been provided in the prior art for maintaining a book open at a desired page. Such apparatus has generally had a number of different disadvantages. These have included the following:

1. The apparatus has been complicated.
2. The apparatus for clamping the pages on one side of the book have generally not been independent from the apparatus for clamping the pages on the other side of the book.
3. The apparatus does not provide for a stable open relationship on each side of an open book so that the reader can easily turn a page from the right side of the book to the left side of the book after the reader has finished reading the page on the right side of the book.
4. The apparatus does not provide a positive clamping action against the pages on the opposite sides of the book in the open relationship of the book.
5. The apparatus tends to damage the pages when it clamps the pages.
6. The apparatus provides more than one (1) constraining member such as a spring.

It will be appreciated that each clamping apparatus does not have all of the disadvantages specified above. However, each clamping apparatus generally has one (1) or more of the disadvantages specified above as that such apparatus is considered undesirable by a reader.

BRIEF DESCRIPTION OF THE INVENTION

This invention provides a page clamping device which overcomes all of the disadvantages specified above. It is constructed with a minimal number of parts and with only a single constraining member (e.g., spring). It provides for an easy turning of pages on one side (with the book open) independently of the pages on the other side of the book. It retains the book open to the desired pages without damaging the pages.

In one embodiment of the invention, first and second pairs of arms in a plurality are respectively disposed at opposite ends of a support structure. A constrainable member (e.g., a spring) is supported at its opposite ends by corresponding ones of the arms in the pairs. This is the only constrainable member in the page clamping device. When the spring is unconstrained, the arms in each pair are normally closed.

The arms in each pair are pivotable independently of the arms in the other pair. The arms in each pair have at fist positions camming peripheries which cause one of such arms to pivot when the other of such arms is pivoted. The arms in each pair have at second positions camming peripheries which provide a stable relationship between the arms when the arms are in an open position. The arms in each pair are disposed on the opposite sides of a book from the arms in the other pair.

With the arms in the open relationship, the pages can be easily turned. When the arms in each pair are pivoted from the open relationship, the arms in such pair become pivoted toward the closed relationship as a result of the constraint on the spring. This causes the arms to clamp the pages on the same side of the book as such arms. Fingers made from a soft non-skid material (e.g., vinyl) may extend from the arms in a transverse direction for disposition on the pages to prevent damage to the pages when the pages are clamped.

BRIEF DESCRIPTION OF THE DRAWINGS

In the drawings:

FIG. 3 is a perspective view of the page clamping device in an open relationship;

FIG. 4 is a perspective view of the page clamping device when the page clamping device is being installed to clamp the page of a book when the book is open;

DETAILED DESCRIPTION OF THE INVENTION

Figure 1:
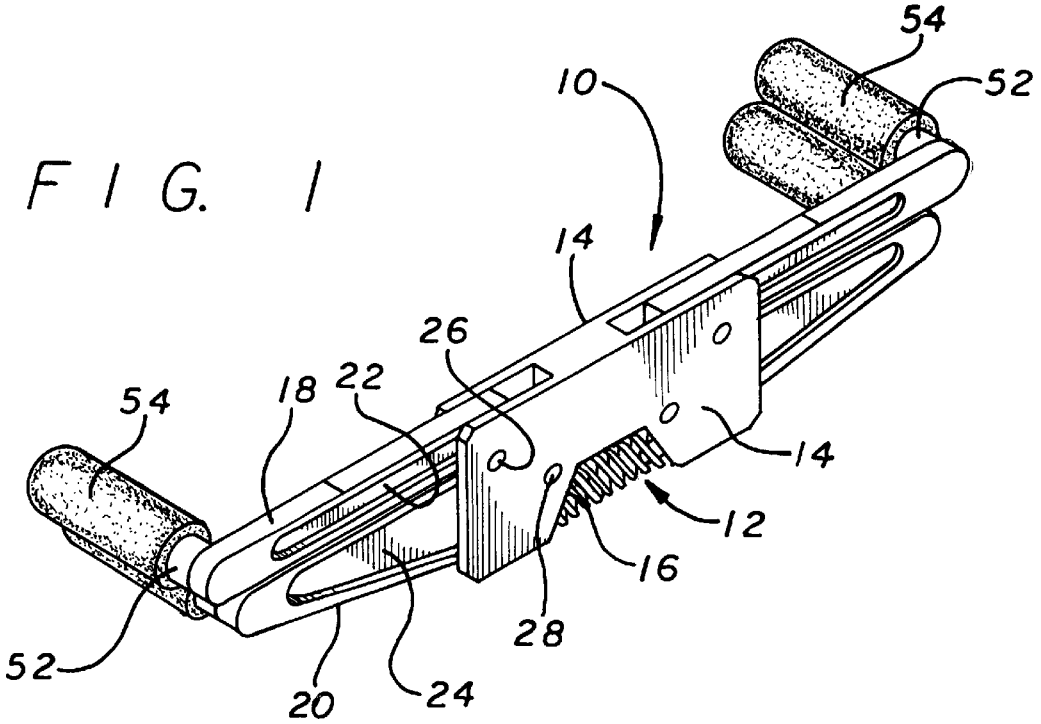
FIG. 1 is a perspective view in a closed relationship of a page clamping device constituting one embodiment of the invention.

In one embodiment of the invention, a page clamping device generally indicated at 10 may be formed from a suitable plastic or a metal. The clamping device 10 includes a support structure generally indicated at 12. The support structure 12 may be formed from a single member which defines a pair of plates 14 disposed in a spaced and parallel relationship. Each of the plates 14 may be provided with a cut-out portion 16 at a position intermediate the opposite ends of the plates.

A first pair of arms 18 and 20 may be disposed at one end of the support structure 12 between the plates 14. The arm 18 is disposed at the upper end of the plate 14 and the arm 20 is disposed at the lower end of the plate 14. The arms 18 and 20 are respectively provided with sockets 22 and 24 along the lengths of the arms to minimize the weight of the arms without reducing the strengths of the arms.

Figure 2:
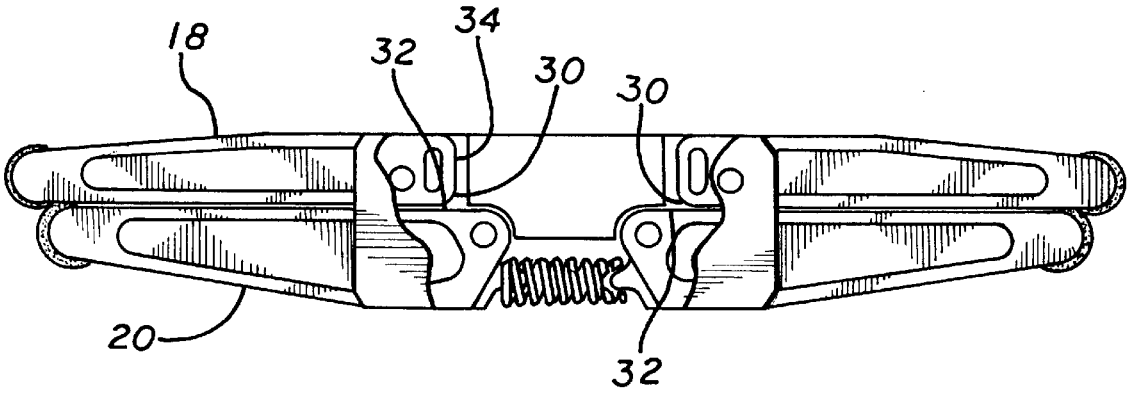
FIG. 2 is a front elevational view of the page clamping device in the closed relationship shown in FIG. 1.
Figure 5:
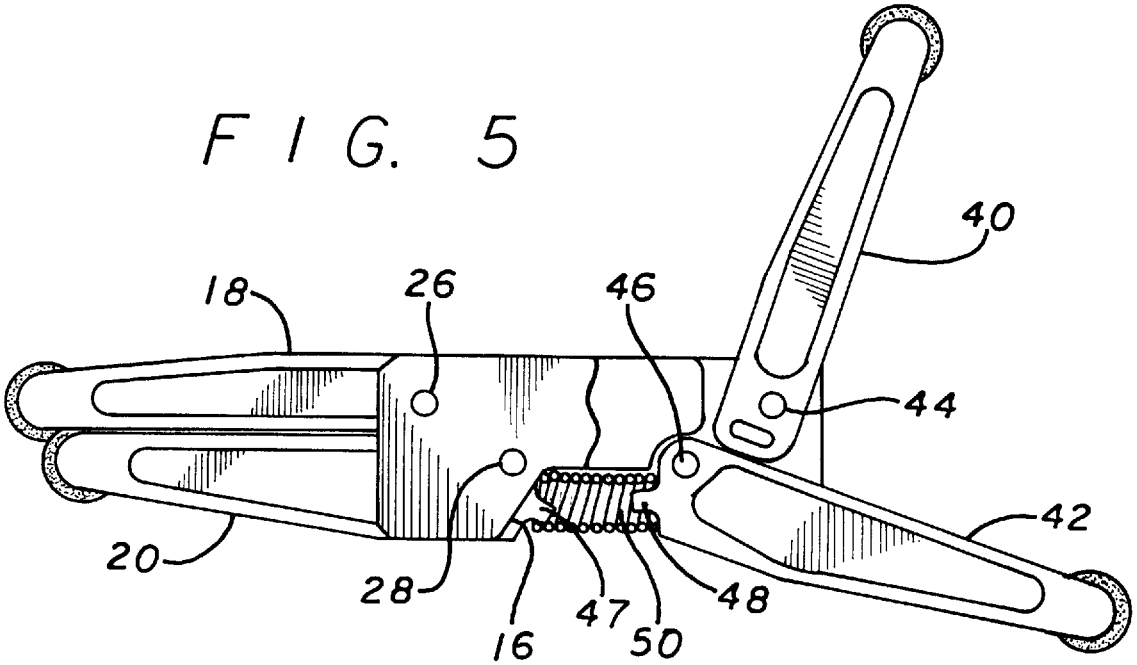
FIG. 5 is a front elevational view of the page clamping device with one side of the device in a closed relationship and the other side of the device in an open relationship.

The arms 18 and 20 are respectively pivotable on pins 26 and 28 each of which extends through the associated one of the arms 18 and 20 into the plates 14. The arm 18 is provided at its periphery with a camming surface 30 (FIG. 2) which operates upon a flat camming surface 32 on the periphery of the arm 20 to pivot the arm 20 in accordance with the pivotal movements of the arm 18. The arm 18 is also provided with a flat surface 34 which is displaced from the camming surface 30. The camming surface 34 co-operates with the flat camming surface 32 on the upper periphery of the arm 20 to maintain a stable disposition of the arms 18 and 20 relative to each other when the arms have an open relationship as shown at the right end in FIG. 5.

Arms 40 and 42 respectively corresponding in construction to the arms 18 and 20 are disposed on the other side of the support plates 14 from the arms 18 and 20. The arms 40 and 42 are respectively disposed on pins 44 and 46 (FIG. 3) for pivotable movement. The pins 44 and 46 respectively correspond to the pins 26 and 28. The arms 40 and 42 are pivotable independently of any pivotable movement of the arms 18 and 20. This may be seen from FIG. 5 of the drawings.

The arms 20 and 42 respectively have tangs 47 and 48 (FIG. 5) which extend into the cut-out portion 16 in the plates 14. The tangs receive the opposite ends of a constrainable member such as a helical spring 50. The spring 50 is disposed in the unconstrained relationship when the arms 18 and 20 and the arms 40 and 42 are disposed in the closed relationships shown in FIGS. 1 and 2.

Figure 8:
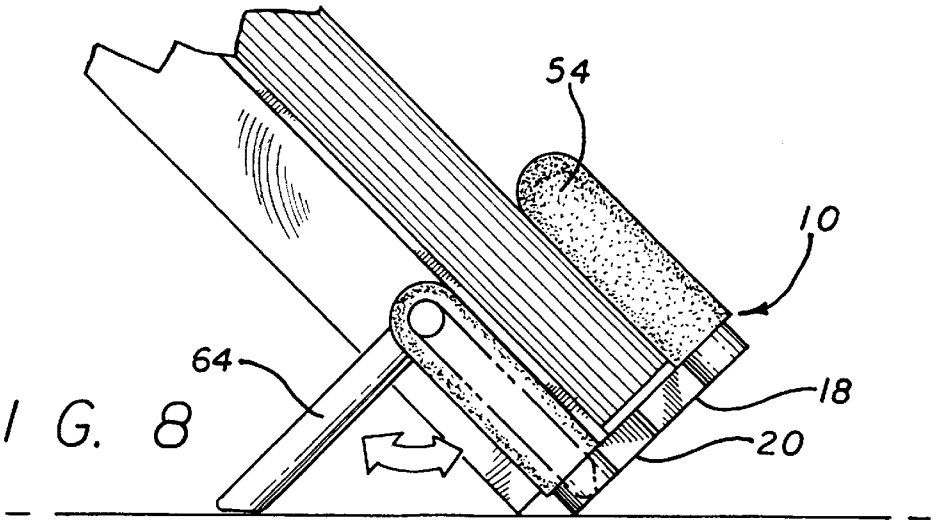
FIG. 8 is a fragmentary perspective view showing a modified embodiment of the invention.

Fingers 52 extend from the outer ends of the arms 18, 20, 40 and 42 in a direction transverse, preferably perpendicular, to the arms. Caps 54 are disposed on the fingers. The caps 54 may be made from a suitable material such as a vinyl with soft non-skid properties to prevent the clamped book pages from being damaged when the caps contact the pages. Struts 64 (FIG. 8) may be provided to tilt the page clamping device 10 upwardly at an angle when the device is disposed on a table top and a book is disposed on the device.

The arms 18 and 20 are closed against each other (see FIGS. 1 and 2), as are the arms 40 and 42, when the page clamping device 10 is not being used. When it is desired to clamp the open pages of a book generally indicated at 56 (FIGS. 4, 6 and 7) and having covers 58 and pages 60 within the covers, the arm 18 is pivoted on the pin 26 to the open position shown in FIG. 3. This causes the arm 20 to be pivoted by the arm 18 to the open position shown in FIG. 3. The arms 40 and 42 are pivoted in like manner to the open position shown in FIG. 3.

In the open positions of the arms 18, 20, 40 and 42, the book covers 58 may rest on the arms 20 and 42 and the arms 18 and 40 are displaced from the pages 60. This allows the pages to be turned freely between the left and right sides of the book. It will be appreciated that the arms 18 and 20 may be pivoted to the open position shown in FIG. 3 independently of any pivotal movement of the arms 40 and 42 and vice verse. Furthermore, the page clamping device 10 and the book 56 may be tilted upwardly by the struts 64 to facilitate a reading of the book.

The arms 18 and 20 remain locked in the open positions shown in FIG. 3 because of the disposition of the flat surface 34 on the arm 18 against the flat surface 38 on the arm 20. A similar relationship is provided for the arms 40 and 42.

Figure 6:
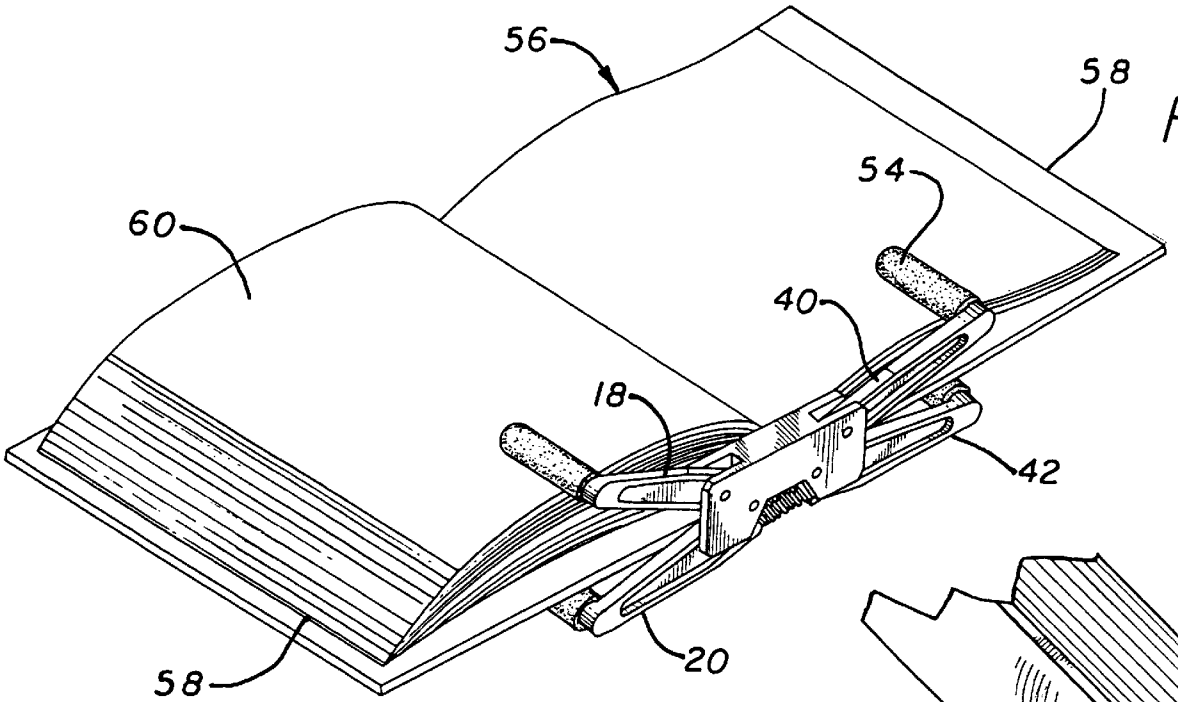
FIG. 6 is a perspective view of the page clamping device with the page clamping device clamping the pages of a book when the book is open.

When it is desired to clamp the arm 18 against the pages 60 on the left side of the book 56, the arm 18 is pivoted downwardly so that the cap 54 on the arm is disposed against the pages. This is shown in FIG. 6. In like manner, the arm 40 is moved downwardly independently of any movements of the arms 18 and 20, to clamp the arm 40 against the pages 60 on the right side of the book.

Figure 7:
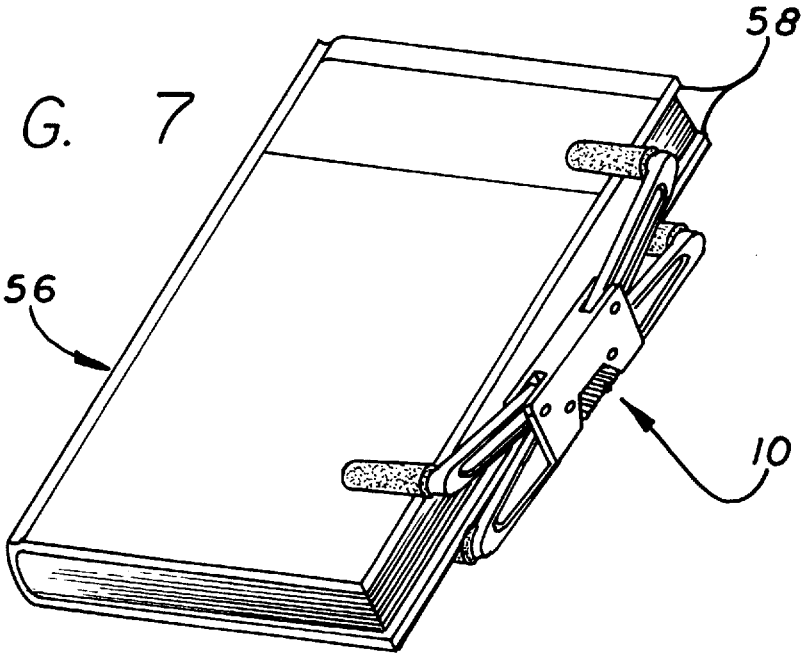
FIG. 7 is a perspective view of the page clamping device with the page clamping device clamping a book when the book is closed.

The page clamping device 10 has certain important advantages. It has a minimal number of parts including only a single constraining member such as the spring 50. It provides an action on the pages on each side of the book 56 independently of any action on the other side of the book. It provides a stable disposition of the arms 18 and 20, and of the arms 40 and 42, in the open position of the arms to facilitate a free turning of the pages 60 in the book 56. It provides a positive clamping action on the pages 60 of the book 56 in the relationship shown in FIGS. 6 and 7. It provides this positive clamping action without damaging any of the pages 60 in the book 56. It also provides a clamping of the book 56 with the book closed as shown in FIG. 7.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

I claim:

1. In combination for clamping the pages of a book, a support, first support members disposed on the support.

a first pair of arms supported on the support by the first support members and normally disposed in a closed relationship and pivotable relative to each other and relative to the first support members, to a first position providing for a turning of the pages on a first side of the book with the book in an open position and with the first side of the book between the arms in the first position of the arms and pivotable to a second position, and having a shape providing for a clamping of the pages on the first side of the book by the first pair of arms in the second position of the arms, second support members disposed on the support, a second pair of arms supported on the support by the second support members and normally disposed in a closed relationship and pivotable relative to each other, and relative to the second support member to a first position providing for a turning of the pages on a second side of the book opposite the first side with the book in the open position and with the second side of the book between the arms in the second pair in the first position of the arms and pivotable to a second position and having a shape providing for a clamping of the pages by the second pair of arms on the second side of the book by the second pair of the arms in the second position of the arms, and a spring member having opposite ends and disposed at its opposite ends between corresponding arms in the first and second pairs and supported at its opposite ends by a corresponding one of the arms in the first and second pairs and having strained and unstrained relationships and disposed in the unstrained relationship in the closed positions of the arms and strainable with movements of the arms to the first and second positions.

2. In a combination as set forth in claim 1, the arms in the first pair being constructed to be disposed in the first position of the arms in a state of equilibrium relative to each other and to be disposed in the second position of the arms in a state of disequilibrium providing for the movement of the arms in the first pair toward each other, the arms in the second pair being constructed to be disposed in the first position of the arms in a state of equilibrium relative to each other and to be disposed in the second position of the arms in a state of disequilibrium providing for the movement of the arms in the second pair toward each other.

3. In a combination as set forth in claim 1, the arms in each of the first and second pairs being movable independently of the arms in the other of the first and second pairs, the first support members constituting a first pair of pivot pins each coupled to one of the arms in the first pair, and the second pair of support members constituting a second pair of pivot pins each coupled to one of the arms in the second pair.

4. In combination for clamping the pages of a book, a support, first support members disposed on the support, a first pair of arms supported on the support by the first support members and normally disposed in a closed relationship and pivotable relative to each other, and relative to the first support members, to a first position providing for a turning of the pages on a first side of the book with the book in an open position and with the first side of the book between the arms in the first position of the arms and pivotable to a second position, and having a shape, providing for a clamping of the pages on the first side of the book by the first pair of arms in the second position of the arms, second support members disposed on the support, a second pair of arms supported on the support by the second support members and normally disposed in a closed relationship and pivotable relative to each other, and relative to the second support members, to a first position providing for a turning of the pages on a second side of the book opposite the first side with the book in the open position and with the second side of the book between the arms in the second pair in the first position of the arms and pivotable to a second position and having a shape providing for a clamping of the pages by the second pair of arms on the second side of the book in the second position of the arms, and a spring member disposed between corresponding arms in the first and second pairs and supported by corresponding ones of the arms in the first and second pairs, the first support members constituting a first pair of pivot pins each respectively coupling one of the arms in the first pair to the support to provide for a pivotal movement of the arm between the closed position and the first and second positions of the arm, and the second support members constituting a second pair of pivot pins each respectively coupling one of the arms in the second pair to the support to provide for a pivotal movement of the arm between the closed position and the first and second positions of the arm.

5. In combination for clamping the pages of a book, a support, first support members disposed on the support, a first pair of arms supported on the support by the first support members and normally disposed in a closed relationship and pivotable relative to each other, and relative to the first support members, to a first position providing for a turning of the pages on a first side of the book with the book in an open position and with the first side of the book between the arms in the first position of the arms and pivotable to a second position and having a shape providing for a clamping of the pages on the first side of the book by the first pair of arms in the second position of the arms, second support members disposed on the support, a second pair of arms supported on the support by the second support members and normally disposed in a closed relationship and pivotable relative to each other, and relative to the second support members, to a first position providing for a turning of the pages on a second side of the book opposite the first side with the book in the open position of the book and with the second side of the book between the arms in the second pair in the first position of the arms and pivotable to a second position, and having a shape, providing for a clamping of the pages by the second pair of arms on the second side of the book in the second position of the arms, and a spring member disposed between corresponding arms in the first and second pairs and supported by a corresponding one of the arms in the first and second pairs, the arms in the first pair being coupled to each other to provide for a pivotal movement of one of the arms in the first pair upon a pivotal movement of the other arm in the first pair between the closed position and the first and second positions of the arms, the arms in the second pair being coupled to each other to provide for a pivotal movement of one of the arms in the second pair upon a pivotal movement of the other arm in the second pair between the closed position and the first and second positions of the arms.

6. In combination for clamping the pages of a book, a support, first support members disposed on the support, a first pair of arms supported on the support by the first support members and normally disposed in a closed relationship and pivotable relative to each other, and relative to the first support members, to a first position providing for a turning of the pages on a first side of the book with the book in an open position and with the first side of the book between the arms in the first position of the arms and pivotable to a second position, and having a shape, providing for a clamping of the pages on the first side of the book by the first pair of arms in the second position of the arms, second support members disposed on the support, a second pair of arms supported on the support by the second support members and normally disposed in a closed relationship and pivotable relative to each other, and relative to the second support member, to a first position providing for a turning of the pages on a second side of the book opposite the first side with the book in the open position and with the second side of the book between the arms in the second pair in the first position of the arms and pivotable to a second position and having a shape providing for a clamping of the pages by the second pair of arms on the second side of the book by the second pair of the arms in the second position of the arms, and a spring disposed between corresponding arms in the first and second pairs and supported by corresponding ones of the arms in the first and second pairs and having strained and unstrained relationships and disposed in the unstrained relationship in the closed positions of the arms, the arms in the first pair being constructed to be disposed in the first position of the arms in a state of equilibrium relative to each other and to be disposed in the second position of the arms in a state of disequilibrium providing for the movement of the first and second arms in the first pair toward each other, the arms in the second pair being constructed to be disposed in the first position of the arms in a state of equilibrium relative to each other and to be disposed in the second position of the arms in a state of disequilibrium providing for the movement of the first and second arms in the second pair toward each other, the arms in each of the first and second pairs being movable independently of the arms in the other of the first and second pairs, the first support members constituting a first pair of pivot pins each respectively coupling one of the arms in the first pair to provide for a pivotal movement of the arm between the closed position and the first and second positions of the arm, and the second support members constituting a second pair of pivot pins each respectively coupling one of the arms in the second pair to provide for a pivotal movement of the arm between the closed position and the first and second positions of the arm, the arms in the first pair being coupled to each other to provide for a pivotal movement of one of the arms in the first pair upon a pivotal movement of the other arm in the first pair between the closed position and the first and second positions of the arms, the arms in the second pair being coupled to each other to provide for a pivotal movement of one of the arms in the second pair upon a pivotal movement of the other arm in the second pair between the closed position and the first and second positions of the arms.

7. In combination for clamping the pages of a book, a support, first support members disposed on the support, a first pair of arms supported on the support by the first support members and normally disposed in a closed relationship and pivotable relative to each other, and relative to the first support members, to a first position providing for a turning of the pages on a first side of the book with the book in an open position and with the first side of the book between the arms in the first position of the arms and pivotable to a second position, and having a shape, providing for a clamping of the pages on the first side of the book by the first pair of arms in the second position of the arms, second support members disposed on the support, a second pair of arms supported on the support by the second support members and normally disposed in a closed relationship and pivotable relative to each other, and relative to the second support member, to a first position providing for a turning of the pages on a second side of the book opposite the first side with the book in the open position and with the second side of the book between the arms in the second pair in the first position of the arms and pivotable to a second position, and having a shape, providing for a clamping of the pages by the second pair of arms on the second side of the book in the second position of the arms, and a spring having opposite ends and disposed between corresponding arms in the first and second pairs and supported at its opposite ends by a corresponding one of the arms in the first and second pairs, a finger extending from each of the arms in the first pair in a direction transverse to the direction of the arms in the first pair to engage the pages of the book on the one side of the book in the open disposition of the book and a finger extending from each of the arms in the second pair in a direction transverse to the arms in the second pair to engage the pages in the book on the other side of the book in the open disposition of the book and caps disposed on the fingers and made from a material having properties of preventing damage to the book pages when the fingers engage the pages.

8. In combination for clamping the pages of a book, a support having first and second opposite sides, a plurality of pivot pins disposed on the support, a first pair of arms respectively supported by a first pair of the pivot pins on the first side of the support for pivotable movement of the arms relative to each other between closed and open positions and for retention of the pages on one side of the book, a second pair of arms respectively supported by a second pair of pivot pins on the second side of the support for pivotable movement relative to each other between closed and open positions and for retention of the pages in the book and a spring supported by a corresponding one of the arms in the first and second pairs, the arms in the first pair, and the arms in the second pair, being disposed relative to each other to provide for a pivotable movement of one of the arms in each pair between the open and closed positions upon a pivotal movement of the other arm in such pair and independently of any pivotal movement of the arms in the other pair, the arms in each of the first and second pairs being shaped to engage the cover and the pages in the book when the arms in each pair are opened relative to each other and the book is disposed in an opened relationship of the book between the opened arms and the arms in each pair are then closed relative to each other.

9. In a combination as set forth in claim 8, the arms in each pair being constructed to provide a stable positioning of such arms in the open position of such arms and to provide an unstable positioning of such arms in any position of such arms between the open and closed positions and to provide a clamping of the pages of the book in the positions of the arms other than the closed and opened positions.

10. In a combination as set forth in claim 9, the spring having an unstrained relationship in the closed positions of the arms in the first and second pairs and having a strained relationship in any position of the arms in the first and second pairs other than the closed positions of such arms to facilitate the clamping of the arms against the pages in the book.

11. In a combination as set forth in claim 8, the spring constituting a single spring coupled at its opposite ends to the corresponding ones of the arms in the first and second pairs to become strained upon a movement of the arms in either one of the first and second pairs from the closed position.

12. In a combination as set forth in claim 8, the arms in each pair being constructed to provide a camming action between the peripheries of such arms for pivoting one of the arms in such pair upon a of the other arm in such pair and one of the arms in each pair being provided with a flat periphery co-operative with the periphery of the other arm in such pair in the open position of such arms to provide for a stable retention of such arms in the open relationship.

13. In a combination as set forth in claim 9, the spring having an unstrained relationship in the closed positions of the arms in the first and second pairs and having a strained relationship in any position of the arms in the first and second pairs other than the closed positions of such arms, the spring being coupled at its opposite ends to the corresponding ones of the arms in the first and second pairs to become strained upon a movement of the arms in at least one of the first and second pairs from the closed position, the arms in each pair being constructed to provide a camming action between the peripheries of such arms for pivoting one of the arms in such pair upon a pivoting of the other arm in such pair and one of the arms in each pair being provided with a flat periphery co-operative with the periphery of the other arm in such pair in the open position of such arms to provide for a stable retention of such arms in the open relationship.

14. In combination for clamping the pages of a book, a support, first support members disposed on the support, a first pair of arms supported on the support by the first support members and normally disposed in a closed relationship and pivotable relative to each other, and relative to the first support members, to a first position providing for a turning of the pages on a first side of the book with the book in an open position and with the first side of the book between the arms in the first position of the arms and pivotable to a second position, and having a shape, providing for a clamping of the pages on the first side of the book by the first pair of arms in the second position of the arms, second support members disposed on the support, a second pair of arms supported on the support by the second support members and normally disposed in a closed relationship and pivotable relative to each other, and relative to the second support members, to a first position providing for a turning of the pages on a second side of the book opposite the first side with the book in the open position and with the second side of the book between the arms in the second pair in the first position of the arms and pivotable to a second position, and having a shape, providing for a clamping of the pages on the second side of the book by the second pair of the arms in the second position of the arms, and a spring having opposite ends and disposed between corresponding arms in the first and second pairs and supported at its opposite ends by a corresponding one of the arms in the first and second pairs and having strained and unstrained relationships and disposed in the unstrained relationship in the closed positions of the arms and strainable with movements of the arms to the first and second positions, and a finger extending from each of the arms in the first pair in a direction transverse to the direction of the arms in the first pair to engage the pages of the book on the one side of the book in the open disposition of the book and a second finger extending from each of the arms in the second pair in a direction transverse to the arms in the second pair to engage the pages in the book on the other side of the book in the open disposition of the book and caps disposed on the fingers and made from a material having properties of preventing damage to the book pages when the fingers engage the pages.

15. In combination for clamping the pages of a book, a support, a first pair of arms supported by the support and normally disposed in a closed relationship and having a camming relationship to provide for a pivotal movement of one of such arms to an open relationship from the closed relationship and shaped to provide a clamping relationship on the pages of the book on one side of the book with the one side of the book disposed between the arms and upon a movement of the arms from the open relationship toward the closed relationship, a second pair of arms supported by the support and normally disposed in a closed relationship and having a camming relationship to provide for a pivotal movement of one of such arms to an open relationship from the closed relationship and shaped to provide a clamping relationship of the pages of the book on the other side of the book with the other side of the book disposed between the arms and upon a movement of the arms in the second pair from the open relationship toward the closed relationship, and a spring supported on corresponding ones of the arms in the first and second pairs to become strained upon a pivotable movement of one of the arms in at least one of the first and second pairs from the closed position.

16. In a combination as set forth in claim 15, each of the arms in the first pair being pivotable to an open relationship relative to the other arm in the first pair and providing a stable camming cooperation with the other arm in the first pair in the open relationship to maintain such arms in the open relationship, each of the arms in the second pair being pivotable to an open relationship relative to the other arm in the second pair and providing a stable camming cooperation with the other arm in the second pair in the open relationship to maintain such arms in the open relationship.

17. In a combination as set forth in claim 15, the spring constituting a helical spring supported at opposite ends on corresponding ones of the arms in the first and second pairs and operative between strained and unstrained positions and normally disposed in the unstained position in the closed relationships of the arms in the first and second pairs and strainable upon a movement of the arms in at least one of the first and second pairs from the closed position.

18. In a combination as set forth in claim 16, the first and second arms in the first pair being provided at first positions with peripheral surfaces having first relative dispositions for providing the camming relationship between such arms and being provided at second positions with peripheral surfaces having second relative dispositions for maintaining such arms in the open relationship;

the first and second arms in the second pair being provided at first positions with peripheral surfaces having second relative dispositions for providing the camming relationship between such arms and being provided at second positions with peripheral surfaces having second relative dispositions for maintaining such arms in the open relationship.

19. In a combination as set forth in claim 16, pivot pins on the support, the arms in each of the first and second pairs being pivotable on the pivot pins between the closed and open positions independently of any pivoting of the arms in the other pair on the pivot pins between the open and closed positions.

20. In a combination as set forth in claim 16, the spring constituting a helical spring supported at opposite ends on corresponding ones of the arms in the first and second pairs and operative between strained and unstrained positions and normally disposed in the unstrained position in the closed relationships of the arms in the first and second pairs and strainable upon a movement of the arms in at least one of the first and second pairs from the closed positions, the arms in the first pair being provided at first positions with peripheral surfaces having first relative dispositions for providing the camming relationship between such arms and being provided at second positions with peripheral surfaces having second relative dispositions for maintaining such arms in the open relationship, the arms in the second pair being provided at first positions with peripheral surfaces having second relative dispositions for providing the camming relationship between such arms and being provided at second positions with peripheral surfaces having second relative dispositions for maintaining such arms in the open relationship, pivot pins on the support, the arms in each of the first and second pairs being pivotable on the pivot pins between the closed and open positions independently of any pivoting of the arms in the other pair on the pivot pins between the open and closed positions, and fingers extending from the arms in each of the first and second pairs for engaging the pages in the book when the arms in such pair have been pivoted from their closed positions to their open positions and the pages in the book have been disposed between the arms in the opened positions of the arms and the arms have then been pivoted toward their closed positions, the fingers being covered with a material preventing the pages in the book from being damaged when the fingers engage the pages.

* * * * *